US008251774B2

(12) United States Patent
Joseph et al.

(10) Patent No.: US 8,251,774 B2
(45) Date of Patent: Aug. 28, 2012

(54) STRUCTURED ABRASIVE ARTICLE, METHOD OF MAKING THE SAME, AND USE IN WAFER PLANARIZATION

(75) Inventors: William D. Joseph, Maplewood, MN (US); Julie Y. Qian, St. Paul, MN (US); Jimmie R. Baran, Jr., Prescott, WI (US); John J. Gagliardi, Hudson, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 317 days.

(21) Appl. No.: 12/539,798

(22) Filed: Aug. 12, 2009

(65) Prior Publication Data

US 2010/0056024 A1 Mar. 4, 2010

Related U.S. Application Data

(60) Provisional application No. 61/092,521, filed on Aug. 28, 2008.

(51) Int. Cl.
*B24B 49/00* (2012.01)

(52) U.S. Cl. ..... 451/6; 451/41; 451/56; 451/533; 51/297

(58) Field of Classification Search ..... 451/41, 451/56, 527, 530, 533; 51/297, 300, 307, 51/308

See application file for complete search history.

(56) References Cited

U.S. PATENT DOCUMENTS

| | | | |
|---|---|---|---|
| 5,152,917 | A | 10/1992 | Pieper et al. |
| 5,551,959 | A | 9/1996 | Martin et al. |
| 5,624,303 | A | 4/1997 | Robinson |
| 5,645,471 | A | 7/1997 | Strecker |
| 5,692,950 | A | 12/1997 | Rutherford et al. |
| 5,879,222 | A | 3/1999 | Robinson |
| 5,958,794 | A | 9/1999 | Bruxvoort et al. |
| 6,007,407 | A | 12/1999 | Rutherford et al. |
| 6,213,845 | B1 | 4/2001 | Elledge |
| 6,329,058 | B1 | 12/2001 | Arney et al. |
| 6,497,957 | B1 | 12/2002 | Border et al. |
| 6,547,640 | B2 | 4/2003 | Hofmann |
| 6,604,985 | B2 | 8/2003 | Muilenburg et al. |
| 6,786,810 | B2 | 9/2004 | Muilenburg et al. |

(Continued)

FOREIGN PATENT DOCUMENTS

| | | | |
|---|---|---|---|
| WO | WO 95/07797 | A1 | 3/1995 |

(Continued)

OTHER PUBLICATIONS

International Search Report, PCT/US2009/052188, Feb. 25, 2010.

(Continued)

*Primary Examiner* — Maurina Rachuba
(74) *Attorney, Agent, or Firm* — Bradford B. Wright

(57) ABSTRACT

A structured abrasive article comprises an at least translucent film backing and an abrasive layer disposed on the backing. The abrasive layer comprises a plurality of shaped abrasive composites. The shaped abrasive composites comprise abrasive particles dispersed in a binder. The abrasive particles consist essentially of ceria particles having an average primary particle size of less than 100 nanometers. The binder comprises a polyether acid and a reaction product of components comprising a carboxylic(meth)acrylate and a poly (meth)acrylate, and, based on a total weight of the abrasive layer, the abrasive particles are present in an amount of at least 70 percent by weight. Methods of making and using the structured abrasive article are also disclosed.

20 Claims, 5 Drawing Sheets

U.S. PATENT DOCUMENTS

| | | | | |
|---|---|---|---|---|
| 6,866,559 | B2 | 3/2005 | Lehman et al. | |
| 6,884,146 | B2 | 4/2005 | Lehman et al. | |
| 6,910,951 | B2 | 6/2005 | Balijepalli et al. | |
| 6,918,821 | B2 | 7/2005 | Balijepalli et al. | |
| 6,929,530 | B1 | 8/2005 | Elledge | |
| 7,052,369 | B2 | 5/2006 | Lehman et al. | |
| 7,066,801 | B2 | 6/2006 | Balijepalli | |
| 7,131,889 | B1 | 11/2006 | Taylor | |
| 7,192,340 | B2 | 3/2007 | Ono et al. | |
| 7,244,678 | B2 | 7/2007 | Sinha et al. | |
| 7,497,885 | B2 * | 3/2009 | Kollodge | 51/307 |
| 2003/0022598 | A1 | 1/2003 | Muilenburg et al. | |
| 2003/0064663 | A1 | 4/2003 | Muilenburg et al. | |
| 2003/0181138 | A1 | 9/2003 | Lehman et al. | |
| 2003/0181139 | A1 | 9/2003 | Lehman et al. | |
| 2004/0005769 | A1 | 1/2004 | Mikolas | |
| 2004/0127045 | A1 | 7/2004 | Gorantla et al. | |
| 2006/0030156 | A1 | 2/2006 | Butterfield et al. | |
| 2006/0040588 | A1 | 2/2006 | Elledge | |
| 2006/0207187 | A1 * | 9/2006 | Gaeta et al. | 51/293 |
| 2006/0288647 | A1 * | 12/2006 | Thurber et al. | 51/307 |
| 2007/0066186 | A1 | 3/2007 | Annen et al. | |
| 2008/0148651 | A1 | 6/2008 | Kollodge | |
| 2009/0176443 | A1 | 7/2009 | Kollodge et al. | |

FOREIGN PATENT DOCUMENTS

| | | | |
|---|---|---|---|
| WO | WO 95/22436 | A1 | 8/1995 |

OTHER PUBLICATIONS

Written Opinion of the International Searching Authority, PCT/US2009/052188, Feb. 25, 2010.

J. Gagliardi, A. Zagrebelny, W. Joseph, L. Zazzera, "Advancements for Sub 45nm Fixed Abrasive STI CMP",NCCAVS CMPUG, Semicon West, Jul. 16, 2007, Proceedings.

Huang, C. K., Gagliardi, J. J., Gleason, E., "A Fixed Abrasive STI Process for 200 nm Rotary Polishing", 2006 Proceedings 11th Intern. Chemical Mechanical Planarization for ULSI Multilevel Interconnection Conference, Feb. 21-23, 2006, pp. 145-151.

* cited by examiner

STRUCTURED ABRASIVE ARTICLE, METHOD OF MAKING THE SAME, AND USE IN WAFER PLANARIZATION

CROSS-REFERENCE TO RELATED APPLICATION

This application claims the benefit of U.S. Provisional Patent Application No. 61/092,521, filed Aug. 28, 2008, the disclosure of which is incorporated by reference herein in its entirety.

TECHNICAL FIELD

The present disclosure broadly relates to abrasive articles, methods of their manufacture, and their use in wafer planarization.

BACKGROUND

Abrasive articles are frequently used in microfinishing applications such as semiconductor wafer polishing, microelectromechanical (MEMS) device fabrication, finishing of substrates for hard disk drives, polishing of optical fibers and connectors, and the like. For example, during integrated circuit manufacture, semiconductor wafers typically undergo numerous processing steps including deposition of metal and dielectric layers, patterning of the layers, and etching. In each processing step, it may be necessary or desirable to modify or refine an exposed surface of the wafer to prepare it for subsequent fabrication or manufacturing steps. The surface modification process is often used to modify deposited conductors (e.g., metals, semiconductors, and/or dielectric materials). The surface modification process is also typically used to create a planar outer exposed surface on a wafer having an exposed area of a conductive material, a dielectric material, or a combination.

One method of modifying or refining exposed surfaces of structured wafers treats a wafer surface with a fixed abrasive article. In use, the fixed abrasive article is typically contacted with a semiconductor wafer surface, often in the presence of a working fluid, with a motion adapted to modify a layer of material on the wafer and provide a planar, uniform wafer surface. The working fluid may be applied to the surface of the wafer to chemically modify or otherwise facilitate the removal of material from the surface of the wafer under the action of the abrasive article.

Fixed abrasive articles generally have an abrasive layer of abrasive particles bonded together by a binder and secured to a backing. In one type of fixed abrasive article, the abrasive layer is composed of discrete raised structural elements (e.g., posts, ridges, pyramids, or truncated pyramids) termed shaped abrasive composites. This type of fixed abrasive article is known in the art variously by the terms "textured, fixed abrasive article" or "structured abrasive article" (this latter term shall be used hereinafter).

In order to assess progress during the planarization process it is common practice to use various detection methods. Optical detection methods (e.g., laser interferometry) are among the most widely used. In such techniques, a laser is typically directed through windows in a platen and a subpad in contact with the structured abrasive article. A hole or transparent (uncoated with abrasive layer) portion of the structured abrasive article is aligned with the beam.

SUMMARY

In one aspect, the present disclosure provides a structured abrasive article comprising:

an at least translucent film backing; and an abrasive layer disposed on the at least translucent film backing and comprising a plurality of shaped abrasive composites, wherein the shaped abrasive composites comprise abrasive particles dispersed in a binder, wherein the abrasive particles consist essentially of ceria particles having an average primary particle size of less than 100 nanometers, wherein the binder comprises a polyether acid and a reaction product of components comprising a carboxylic(meth)acrylate and a poly(meth)acrylate, and wherein, based on a total weight of the abrasive layer, the abrasive particles are present in an amount of at least 70 percent by weight. Typically, the average particle size (on a volume basis), as measured by light scattering techniques, is also less than 100 nanometers.

In certain embodiments, if viewed perpendicular to the abrasive layer, the structured abrasive article has an optical transmission in a wavelength range of from 633 to 660 nanometers (e.g., 633 nanometers) of at least 3.5 percent.

In certain embodiments, the shaped abrasive composites consist essentially of posts lengthwise oriented perpendicular to the at least translucent film backing.

In another aspect, the present disclosure provides a method of making a structured abrasive article, the method comprising:

combining ceria particles, a polyether acid, a carboxylic (meth)acrylate, and solvent to form a dispersion, wherein the ceria particles have an average primary particle size of less than 100 nanometers;

combining the dispersion with components comprising a poly(meth)acrylate to form a binder precursor;

forming a layer of the binder precursor on an at least translucent film backing;

contacting the binder precursor with a production tool having a plurality of precisely-shaped cavities;

curing the binder precursor to form an abrasive layer disposed on the at least translucent film backing;

separating the abrasive layer from the production tool to provide the structured abrasive article, wherein based on a total weight of the abrasive layer, the ceria particles are present in an amount of at least 70 percent by weight.

In certain embodiments, the carboxylic(meth)acrylate comprises beta-carboxyethyl acrylate. In certain embodiments, the components further comprise a mono(meth)acrylate. In certain embodiments, the components further comprise a free-radical photoinitiator, and curing the binder precursor is achieved by radiation curing. In certain embodiments, the components further comprise a free-radical thermal initiator. In certain of those embodiments, the method of making a structured abrasive article further comprises thermally post-curing the abrasive layer.

In another aspect, the present disclosure provides a method of conditioning an oxide surface of a wafer, the method comprising:

providing a structured abrasive article comprising:

an at least translucent film backing; and an abrasive layer disposed on the at least translucent film backing and comprising a plurality of shaped abrasive composites, wherein the shaped abrasive composites comprise abrasive particles dispersed in a binder, wherein the abrasive particles consist essentially of ceria particles having an average primary particle size of less than 100 nanometers, wherein the binder comprises a polyether acid and a reaction product of components comprising a carboxylic(meth)acrylate and a poly (meth)acrylate, and wherein based on a total weight of the abrasive layer, the abrasive particles are present in an amount of at least 70 percent by weight;

conditioning the abrasive layer;

contacting the at least translucent film backing with a subpad, the subpad having a first window extending therethrough;

securing the subpad to a platen, the platen having a second window extending therethrough and contiguous with the first window;

frictionally contacting the abrasive layer with the oxide surface of the wafer; and moving at least one of the abrasive layer or the wafer to abrade the surface of the wafer while in contact with a working fluid; and monitoring a surface characteristic of the wafer using a visible light beam directed through the first window, the second window, and the structured abrasive article.

In certain embodiments, the visible light beam comprises a laser beam.

Addition of ceria to slurries used in manufacture of prior structured abrasive articles is generally limited due to pronounced increase in shear viscosity of the slurry with increasing ceria content. In addition, it is typically necessary to include a surfactant in such slurries in order in disperse the ceria. Such surfactants can be detrimental to performance of the structured abrasive article in chemical mechanical planarization (i.e., CMP) processes.

Advantageously, structured abrasive articles made according to methods of the present disclosure typically exhibit low shear increase in viscosity, thereby permitting the incorporation of high levels of ceria. Moreover, surfactant is typically not required to achieve a good quality ceria dispersion. Further, by contacting the ceria with a carboxylic acrylate prior to incorporation into the coating slurry, Applicants have discovered that problems encountered with shortened pot-life (e.g., premature initiation of polymerization of the poly(meth)acrylate by the ceria mineral) of some prior art formulations is substantially or completely alleviated.

Still more advantageously, structured abrasive articles according to the present disclosure can be fabricated with sufficient optical transmittance and clarity across the entire surface of the structured abrasive article that it is possible to use optical endpoint detection (e.g., laser interferometry endpoint detection) during wafer planarization without needing to provide windows or perforations in the structured abrasive article to allow passage of the laser beam therethrough.

As used herein:

the term "abrasive particle" refers to any particle having a hardness equal or greater to that of ceria;

the term "at least translucent" means translucent or transparent;

the term "carboxylic(meth)acrylate" means a compound having a (meth)acrylate group covalently linked to a carboxyl ($—CO_2H$) or carboxylate ($—CO_2—$) group;

the term "visible light" refers to light having a wavelength in a range of from 400 nanometers to 700 nanometers, inclusive;

the term "(meth)acryl" includes acryl and/or methacryl;

the term "optical transmission" means the fraction of incident light transmitted through an object;

the term "poly(meth)acrylate" means a compound having at least two (meth)acrylate groups;

the term "transparent" means capable of transmitting visible light so that objects or images can be seen substantially as if there were no intervening material; and the terms "cerium oxide" and "ceria" refer to $Ce(IV)O_2$;

DETAILED DESCRIPTION

Figure 1:
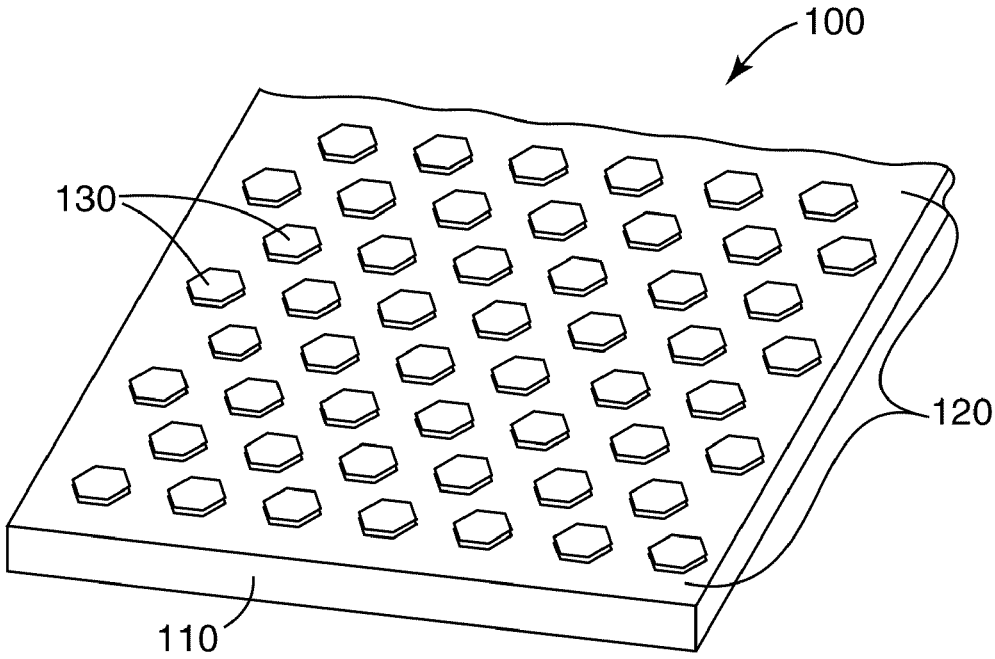
FIG. 1 is a perspective view of an exemplary structured abrasive article according to one embodiment according to the present disclosure.

Referring now to FIG. 1, structured abrasive article 100 comprises at least translucent film backing 110. Abrasive layer 120 is disposed on at least translucent film backing 110 and comprises a plurality of shaped abrasive composites 130. Shaped abrasive composites 130 comprise abrasive particles (not shown) dispersed in a binder (not shown). The abrasive particles consist essentially of ceria particles having an average primary particle size of less than 100 nanometers. The binder comprises a polyether acid and a reaction product of components comprising a carboxylic(meth)acrylate and a poly(meth)acrylate, and wherein based on a total weight of the abrasive layer, the abrasive particles are present in an amount of at least 70 percent by weight.

The at least translucent film backing may be flexible, rigid, or in between. A variety of backing materials are suitable for this purpose, including both flexible backings and backings that are more rigid. Useful at least translucent film backings include backing films selected from polymer films, treated versions thereof, and combinations thereof. Exemplary at least translucent backing films include films made from polyester (e.g., polyethylene terephthalate or polycaprolactone), co-polyester, polycarbonate, polyimide, polyamide, polypropylene, polyethylene, cellulosic polymers, and blends and combinations thereof.

The thickness of the at least translucent film backing generally is typically in a range of from about 20 to about 1000 micrometers, more typically, from about 50 micrometers to about 500 micrometers, and more typically from about 60 micrometers to about 200 micrometers. At least one surface of the backing may be coated with the abrasive layer. In general, the backing is of substantially uniform in thickness. If the backing is not sufficiently uniform in thickness, greater variability in wafer polishing uniformity may occur during wafer planarization.

The abrasive layer comprises a plurality of shaped abrasive composites. As used herein, the term "shaped abrasive composite" refers to one of a plurality of shaped bodies comprising abrasive particles dispersed in a binder, the shaped bodies collectively providing a textured, three-dimensional abrasive layer. In some embodiments, the shaped abrasive composites are "precisely-shaped". The term "precisely-shaped abrasive composite" refers to an abrasive composite having a molded shape that is substantially the inverse of a mold cavity used to make it. Typically, precisely-shaped abrasive composites are substantially free of abrasive particles protruding beyond the exposed surface of the abrasive composite before the structured abrasive article has been used.

Advantageously, structured abrasive articles according to the present disclosure having a high weight content of abrasive particles in the shaped abrasive composites. For example the shaped abrasive composites comprise, on a weight basis, at least 70 percent of the shaped abrasive composites; and may comprise at least 75, 80, or even 85 percent by weight of the abrasive layer, or more. Typically, higher weight percentage of the abrasive particles in the shaped abrasive composites results in higher cut.

The abrasive particles consist essentially of ceria (i.e., cerium oxide) particles having a average particle size, on a volume basis, of less than 100 nanometers. The phrase "consist essentially of" used in this context is intended to exclude other (i.e., non-ceria) abrasive particles in amounts that materially affect abrading properties of the structured abrasive article, if used in wafer planarization of silicon-containing wafers. It will be recognized that that the ceria particles may comprise agglomerates and/or aggregates of smaller primary ceria particles. For example, the ceria particles (whether present as primary particle, agglomerates, aggregates, or a combination thereof) may have an average particle size, on a volume basis, in a range of from 1, 5, 10, 20, 30, or 40 nanometers up to 50, 60, 70, 80, 90, 95 nanometers, or more.

The ceria particles can be supplied, for example, in the form of a powder, dispersion, or sol; typically, as a dispersion or sol. Methods and sources for obtaining ceria sols having an average particle size less than 100 nanometers are well known in the art. Ceria dispersions and sols suitable for use in the present disclosure include, for example, ceria sols and dispersions commercially available for suppliers such as Evonik Degussa Corp. of Parsippany, N.J.; Rhodia, Inc. of Cranberry, N.J.; and Umicore SA, Brussels, Belgium.

The abrasive particles may be homogeneously or heterogeneously dispersed in the polymeric binder. The term "dispersed" refers to the abrasive particles being distributed throughout the polymeric binder. Dispersing the ceria particles substantially homogeneously in the binder typically increases performance of the structured abrasive article. Accordingly, it is typically useful to treat the ceria particles with a carboxylic(meth)acrylates to facilitate their dispersibility and/or reduce aggregation, and enhance subsequent coupling to the binder. Exemplary carboxylic(meth)acrylates include (meth)acrylic acid, monoalkyl esters of maleic acid, fumaric acid, monoalkyl esters of fumaric acid, maleic acid, itaconic acid, isocrotonic acid, crotonic acid, citraconic acid, and beta-carboxyethyl(meth)acrylate.

In one exemplary method for treating the ceria particles with a carboxylic(meth)acrylate, a dispersion (e.g., a sol) of the ceria particles in an aqueous medium (e.g., water) is combined with a polyether acid and carboxylic(meth)acrylate (in amounts of each that are sufficient to surface treat and thereby stabilize the ceria particles) and a water-miscible organic solvent having a higher boiling point than water. Typically, the proportion of polyether acid to carboxylic (meth)acrylate is in a range of from about 3:5 to 5:3, although other proportions may be used. Examples of useful solvents include 1-methoxy-2-propanol, dimethylformamide, and diglyme. Once combined, the water is substantially removed by evaporation under reduced pressure resulting in a ceria dispersion in which the ceria particles are stabilized against aggregation by associated carboxylic(meth)acrylate molecules. This resultant ceria dispersion can typically be readily combined with the poly(meth)acrylate and optional mono (meth)acrylate monomers, and any additional carboxylic (meth)acrylate that may be included in the binder precursor.

While the carboxylic(meth)acrylate typically serves to facilitate bonding of the ceria particles to the binder, the polyether acid is included primarily to facilitate dispersion stability of the ceria particles in the binder (or its precursor components) and/or solvent. As used herein, the term refers to a compound having a polyether segment covalently to an acidic group or salt thereof. Exemplary polyether segments include polyethylene glycol segments, polyethylene glycol segments, and mixed poly(ethylene glycol/propylene glycol) segments. Exemplary acidic groups include —$CO_2H$, —$PO_2H$, —$PO_3H$, —$SO_3H$, and salts thereof. In certain embodiments, the polyether acids have up to 12 carbon atoms, inclusive, and are represented by the formula:

$$R^1—(R^2—O)_n—X\text{-}A$$

wherein: $R^1$ represents H, an alkyl group having from 1 to 6 carbon atoms (e.g., methyl ethyl, or propyl), or an alkoxy group having from 1 to 6 carbon atoms (e.g., methoxy, ethoxyl, or propoxy); each $R^2$ independently represents a divalent alkylene group having from 1 to 6 carbon atoms (e.g., ethylene, propylene, or butylene); n represents a positive integer (e.g., 1, 2, or 3; and X represents a divalent organic linking group or a covalent bond; and A represents an acidic group (e.g., as described hereinabove). Exemplary such polyether acids include 2'-(2"-methoxyethoxy)ethyl succinate (monoester), methoxyethoxyethoxyacetic acid, and methoxyethoxyacetic acid.

The binder further comprises a reaction product of components comprising a carboxylic(meth)acrylate and a poly (meth)acrylate. As discussed above, at least a portion of the carboxylic(meth)acrylate is typically combined with the abrasive particles prior to combining the resultant dispersion with the remaining binder components, although this is not a requirement.

In some embodiments, the components may also include one or more of: a free-radical photoinitiator, a free-radical thermal initiator, antioxidant, colorant, and filler (the filler having substantially no impact on abrading performance). Accordingly, the binder is typically prepared from a binder precursor comprising the components, and in which the abrasive particles are dispersed (e.g., as a slurry).

Suitable binder precursors are typically, in an uncured state, flowable at or near ambient conditions. The binder precursor is typically exposed to conditions (typically an energy source) that at least partially cure (i.e., free-radical polymerization) the binder precursor, thereby converting it into a binder capable of retaining the dispersed abrasive particles. Exemplary energy sources include: e-beam, ultraviolet radiation, visible radiation, infrared radiation, gamma radiation, heat, and combinations thereof.

Useful poly(meth)acrylates include monomers and/or oligomers that have at least two (meth)acrylate groups; for example, tri(meth)acrylates, and tetra(methacrylates). Exemplary poly(methacrylates) include: di(meth)acrylates such as, for example, 1,3-butylene glycol di(meth)acrylate, 1,4-butanediol di(meth)acrylate, 1,6-hexanediol di(meth)acrylate, 1,6-hexanediol mono(meth)acrylate mono(meth)acrylate, ethylene glycol di(meth)acrylate, alkoxylated aliphatic di(meth)acrylate, alkoxylated cyclohexanedimethanol di(meth)acrylate, alkoxylated hexanediol di(meth)acrylate, alkoxylated neopentyl glycol di(meth)acrylate, caprolactone modified neopentyl glycol hydroxypivalate di(meth)acrylate, caprolactone modified neopentyl glycol hydroxypivalate di(meth)acrylate, cyclohexanedimethanol di(meth)acrylate, diethylene glycol di(meth)acrylate, dipropylene glycol di(meth)acrylate, ethoxylated (10) bisphenol A di(meth)acrylate, ethoxylated (3) bisphenol A di(meth)acrylate, ethoxylated (30) bisphenol A di(meth)acrylate, ethoxylated (4) bisphenol A di(meth)acrylate, hydroxypivalaldehyde modified trimethylolpropane di(meth)acrylate, neopentyl glycol di(meth)acrylate, polyethylene glycol (200) di(meth)acrylate, polyethylene glycol (400) di(meth)acrylate, polyethylene glycol (600) di(meth)acrylate, propoxylated neopentyl glycol di(meth)acrylate, tetraethylene glycol di(meth)acrylate, tricyclodecanedimethanol di(meth)acrylate, triethylene glycol di(meth)acrylate, tripropylene glycol di(meth)acrylate; tri(meth)(meth)acrylates such as glycerol tri(meth)acrylate, trimethylolpropane tri(meth)acrylate, ethoxylated tri (meth)acrylates (e.g., ethoxylated (3) trimethylolpropane tri (meth)acrylate, ethoxylated (6) trimethylolpropane tri(meth) acrylate, ethoxylated (9) trimethylolpropane tri(meth) acrylate, ethoxylated (20) trimethylolpropane tri(meth) acrylate), pentaerythritol tri(meth)acrylate, propoxylated tri (meth)acrylates (e.g., propoxylated (3) glyceryl tri(meth) acrylate, propoxylated (5.5) glyceryl tri(meth)acrylate, propoxylated (3) trimethylolpropane tri(meth)acrylate, propoxylated (6) trimethylolpropane tri(meth)acrylate), trimethylolpropane tri(meth)acrylate, tris(2-hydroxyethyl)isocyanurate tri(meth)acrylate; and higher functionality (meth) acryl containing compounds such as ditrimethylolpropane tetra(meth)acrylate, dipentaerythritol penta(meth)acrylate, ethoxylated (4) pentaerythritol tetra(meth)acrylate, pentaerythritol tetra(meth)acrylate, caprolactone modified dipentaerythritol hexa(meth)acrylate; oligomeric(meth)acryl compounds such as, for example, polyester(meth)acrylates, epoxy(meth)acrylates; and combinations thereof. Such compounds are widely available from vendors such as, for example, Sartomer Co. of Exton, Pa.; UCB Chemicals Corporation of Smyrna, Ga.; and Aldrich Chemical Company of Milwaukee, Wis.

The binder precursor may comprise an effective amount of at least one photoinitiator; for example, in an amount of from 0.1, 1, or 3 percent by weight, up to 5, 7, or even 10 percent by weight, or more. Useful photoinitiators include those known as useful for free-radically photocuring (meth)acrylates. Exemplary photoinitiators include benzoin and its derivatives such as alpha-methylbenzoin; alpha-phenylbenzoin; alpha-allylbenzoin; alpha-benzylbenzoin; benzoin ethers such as benzil dimethyl ketal (available as IRGACURE 651 from Ciba Specialty Chemicals, Tarrytown, N.Y.), benzoin methyl ether, benzoin ethyl ether, benzoin n-butyl ether; acetophenone and its derivatives such as 2-hydroxy-2-methyl-1-phenyl-1-propanone (available as DAROCUR 1173 from Ciba Specialty Chemicals) and 1-hydroxycyclohexyl phenyl ketone (available as IRGACURE 184 from Ciba Specialty Chemicals); 2-methyl-1-[4-(methylthio)phenyl]-2-(4-morpholinyl)-1-propanone (available as IRGACURE 907 from Ciba Specialty Chemicals); 2-benzyl-2-(dimethylamino)-1-[4-(4-morpholinyl)phenyl]-1-butanone (available as IRGACURE 369 from Ciba Specialty Chemicals); and (phenyl bis(2,4,6-trimethylbenzoyl)phosphine oxide (available as IRGACURE 819 from Ciba Specialty Chemicals, NY. Other useful photoinitiators include mono- and bis-acylphosphines (available, for example, from Ciba Specialty Chemicals as IRGACURE 1700, IRGACURE 1800, IRGACURE 1850, and DAROCUR 4265).

The binder precursor may comprise an effective amount of at least one thermal initiator; for example, in an amount of from 0.1, 1, or 3 percent by weight, up to 5, 7, or even 10 percent by weight, or more. Exemplary thermal free-radical initiators include: azo compounds such as, for example, 2,2-azo-bisisobutyronitrile, dimethyl 2,2'-azobis(isobutyrate), azobis(diphenyl methane), 4,4'-azobis-(4-cyanopentanoic acid), (2,2'-azobis(2,4-dimethylvaleronitrile (available as VAZO 52 from E. I. du Pont de Nemours and Co. of Wilmington, Del.); peroxides such as, for example, benzoyl peroxide, cumyl peroxide, tert-butyl peroxide, cyclohexanone peroxide, glutaric acid peroxide, and dilauryl peroxide; hydrogen peroxide; hydroperoxides such as, for example, tert butyl hydroperoxide and cumene hydroperoxide; peracids such as, for example, peracetic acid and perbenzoic acid; potassium persulfate; and peresters such as, for example, diisopropyl percarbonate.

In some embodiments, it may be desirable to include one or more monoethylenically unsaturated free-radically polymerizable compounds in the binder precursor; for example, to reduce viscosity and/or or reduce crosslink density in the resultant binder. Exemplary monoethylenically unsaturated free-radically polymerizable compounds include: mono (meth)acrylates include hexyl(meth)acrylate, 2-ethylhexyl acrylate, isononyl(meth)acrylate, isobornyl(meth)acrylate, phenoxyethyl(meth)acrylate, 2-hydroxyethyl(meth)acrylate, dodecyl(meth)acrylate, methyl(meth)acrylate, ethyl(meth) acrylate, n-propyl(meth)acrylate, n-butyl(meth)acrylate, n-octyl(meth)acrylate, isobutyl(meth)acrylate, cyclohexyl (meth)acrylate, or octadecyl(meth)acrylate; N-vinyl compounds such as, for example, N-vinylformamide, N-vinylpyrrolidinone, or N-vinylcaprolactam; and combinations thereof.

Structured abrasive articles according to the present disclosure can be made by general methods well-known in the art. For example, in one method a binder precursor and abrasive particles, in the form of a slurry, is urged into complementary cavities in a production tool that have the dimensions of the desired shaped abrasive composites. Then, the at least translucent film backing is brought into contact with the production tool and slurry precursor and the binder precursor is at least sufficiently cured to remove the shaped abrasive composites from the production tool. Alternatively, the production tool, at least translucent film backing, and slurry may be simultaneously fed through a nip. Optionally, further curing (e.g., thermal post curing) may be carried out at this stage to further advance the degree of cure and thereby improve the binder properties. Further details concerning methods for forming shaped abrasive composites may be found in, for example, U.S. Pat. No. 5,152,917 (Pieper et al.).

Individual shaped abrasive composites may have the form of any of a variety of geometric solids or be irregularly shaped. Typically, the shaped abrasive composites are precisely-shaped (as defined above). Typically, the shaped abrasive composite is formed such that the base of the shaped abrasive composite, for example, that portion of the shaped abrasive composite is in contact with, and secured to, the at least translucent film backing. The proximal portion of the shaped abrasive composite typically has the same or larger a larger surface area than that portion of the shaped abrasive composite distal from the base or backing. Precisely-shaped abrasive composites may be selected from among a number of geometric solids such as a cubic, cylindrical, prismatic (e.g., hexagonal prisms), rectangular pyramidal, truncated pyramidal, conical, hemispherical, truncated conical, cross, or post-like cross sections with a distal end. Composite pyramids may have four sides, five sides or six sides. The shaped abrasive composites may also have a mixture of different shapes. The shaped abrasive composites may be arranged in rows, in concentric circles, in helices, or in lattice fashion, or may be randomly placed.

The sides forming the shaped abrasive composites may be perpendicular relative to the backing, tilted relative to the backing or tapered with diminishing width toward the distal end. However, if the sides are tapered, it may be easier to remove the shaped abrasive composite from the cavities of a mold or production tool. The substantially perpendicular angles are preferred because this results in a consistent nominal contact area as the composite wears.

The height of each shaped abrasive composite is typically substantially the same, but it is envisaged to have composites of varying heights in a single structured abrasive article. The height of the composites with respect to the backing or to the land between the composites generally may be less than about 2,000 micrometers; for example, in a range of from about 10 micrometers to about 200 micrometers. The base dimension of an individual shaped abrasive composite may be about 5,000 micrometers or less, typically about 1,000 micrometers or less, more typically less than 500 micrometers. The base dimension of an individual shaped abrasive composite is typically greater than about 50 micrometers, more typically greater than about 100 micrometers. The base of the shaped abrasive composites may abut one another, or may be separated from one another by some specified distance.

Adjacent shaped composites may share a common shaped abrasive composite land or bridge-like structure which contacts and extends between facing sidewalls of the composites. Typically, the land structure has a height of no greater than about 33 percent of the vertical height dimension of each adjacent composite. The shaped abrasive composite land may be formed from the same slurry used to form the shaped abrasive composites. The composites are "adjacent" in the sense that no intervening composite may be located on a direct imaginary line drawn between the centers of the composites. At least portions of the shaped abrasive composites may be separated from one another so as to provide the recessed areas between the raised portions of the composites.

The linear spacing of the shaped abrasive composites may range from about 1 shaped abrasive composite per linear cm to about 200 shaped abrasive composites per linear cm. The linear spacing may be varied such that the concentration of composites may be greater in one location than in another. For example, the concentration may be greatest in the center of the abrasive article. The areal density of the composite may range, in some embodiments, from about 1 to about 40,000 composites per square centimeter. One or more areas of the backing may be exposed, i.e., have no abrasive coating contacting the at least translucent film backing.

The shaped abrasive composites are typically set out on a backing in a predetermined pattern or set out on a backing at a predetermined location. For example, in the abrasive article made by providing slurry between the backing and a production tool having cavities therein, the predetermined pattern of the composites will correspond to the pattern of the cavities on the production tool. The pattern may be thus reproducible from article to article. For example, the shaped abrasive composites may form an array or arrangement, by which may be meant that the composites are in a regular array such as aligned rows and columns, or alternating offset rows and columns. If desired, one row of shaped abrasive composites may be directly aligned in front of a second row of shaped abrasive composites. Typically, one row of shaped abrasive composites may be offset from a second row of shaped abrasive composites.

In another embodiment, the shaped abrasive composites may be set out in a "random" array or pattern. By this it may be meant that the composites are not in a regular array of rows and columns as described above. For example, the shaped abrasive composites may be set out in a manner as described in PCT Publications WO 95/07797 (Hoopman et al.) and WO 95/22436 (Hoopman et al.). It will be understood, however, that this "random" array may be a predetermined pattern in that the location of the composites on the abrasive article may be predetermined and corresponds to the location of the cavities in the production tool used to make the abrasive article.

Exemplary production tools include rolls, endless belts, and webs, and may be made of an suitable material such as for example, metal (e.g., in the case of rolls) or polymer films (e.g., in the cases of endless belts and webs).

Structured abrasive articles according to the present disclosure may be generally circular in shape, e.g., in the form of an abrasive disc. Outer edges of the abrasive disc are typically smooth, or may be scalloped. The structured abrasive articles may also be in the form of an oval or of any polygonal shape such as triangular, square, rectangular, and the like. Alternatively, the abrasive articles may be in the form of a belt. The abrasive articles may be provided in the form of a roll, typically referred to in the abrasive art as abrasive tape rolls. In general, the abrasive tape rolls may be indexed or moved continuously during the wafer planarization process. The abrasive article may be perforated to provide openings through the abrasive coating and/or the backing to permit the passage of the working fluid before, during and/or after use; although, in advantageous embodiments the structured abrasive articles are substantially free of, or even completely free of, such perforations.

The at least translucent film backing of the structured abrasive articles is typically contacted with a subpad during use. In some cases, the structured abrasive article may be secured to the subpad. The abrasive layer may be applied to a front surface of the at least translucent film backing and an adhesive, for example a pressure-sensitive adhesive (or mechanical fastening device) may be applied to the opposing surface of the at least translucent film backing. Suitable subpads are described, for example, in U.S. Pat. Nos. 5,692,950 and 6,007,407 (both to Rutherford et al.). If using optical detection methods, the subpad, and any platen on which it rests, should have at least one appropriately sized window (e.g., an opening or transparent insert) to permit a continuous optical path from a light source (e.g., a laser) through the platen and subpad.

Advantageously, structured abrasive articles according to the present disclosure can be fabricated such that they have sufficient optical transmittance to be suitable for use with optical detection methods such as, for example, laser interferometry. For example, the structured abrasive article may have an optical transmission of at least 1.5, 2.0, 2.5, 3.0, 3.5, 4.0, 4.5, or even 5.0 percent, or more, over any wavelength range; for example, corresponding to the output wavelength of a laser. Exemplary laser wavelengths include: 694 nm (ruby), 676.4 nm (Kr-ion), 647.1 nm (Kr-ion), 635-660 nm (InGaAlP semiconductor), 633 nm (HeNe), 628 nm (ruby), 612 nm (HeNe), 578 (Cu vapor), 568.2 nm (Kr-ion), 543 nm (HeNe), 532 nm (DPSS semiconductor), 530.9 nm (Kr-ion), 514.5 nm (Ar-ion), 511 nm (Cu vapor), 501.7 nm (Ar), 496.5 nm (Ar), 488.0 nm (Ar), 476.5 nm (Ar), 457.9 nm (Ar), 442 nm (HeCd), or 428 nm ($N_2^+$).

Structured abrasive articles according to the present disclosure may be used for abrading and/or polishing wafers containing silicon (e.g., silicon wafers, glass wafers, etc.) including those having an oxide layer on an outer surface thereof. For example, the structured abrasive articles may be useful in abrading and/or polishing a dielectric material deposited on the wafer and/or the wafer itself. Variables that affect the wafer polishing rate and characteristics include, for example, the selection of the appropriate contact pressure between the wafer surface and abrasive article, type of working fluid, relative speed and relative motion between the wafer surface and the abrasive article, and the flow rate of the working fluid. These variables are interdependent, and are typically selected based upon the individual wafer surface being processed.

Structured abrasive articles according to the present disclosure may be conditioned, for example, by abrading the surface using a pad conditioner (e.g., with diamond grits held in a metal matrix) prior to and/or intermittently during the wafer planarization process. One useful conditioner is a CMP pad conditioner (typically mounted on a rigid backing plate), part no. CMP-20000TS, available from Morgan Advanced Ceramics of Hayward, Calif.

In general, since there can be numerous process steps for a single semiconductor wafer, the semiconductor fabrication industry expects that the process will provide a relatively high removal rate of material. The material removal rate obtained with a particular abrasive article will typically vary depending upon the machine conditions and the type of wafer surface being processed. However, although it is typically desirable to have a high conductor or dielectric material removal rate, the conductor or dielectric material removal rate may be selected such that it does not compromise the desired surface finish and/or topography of the wafer surface.

Figure 2:
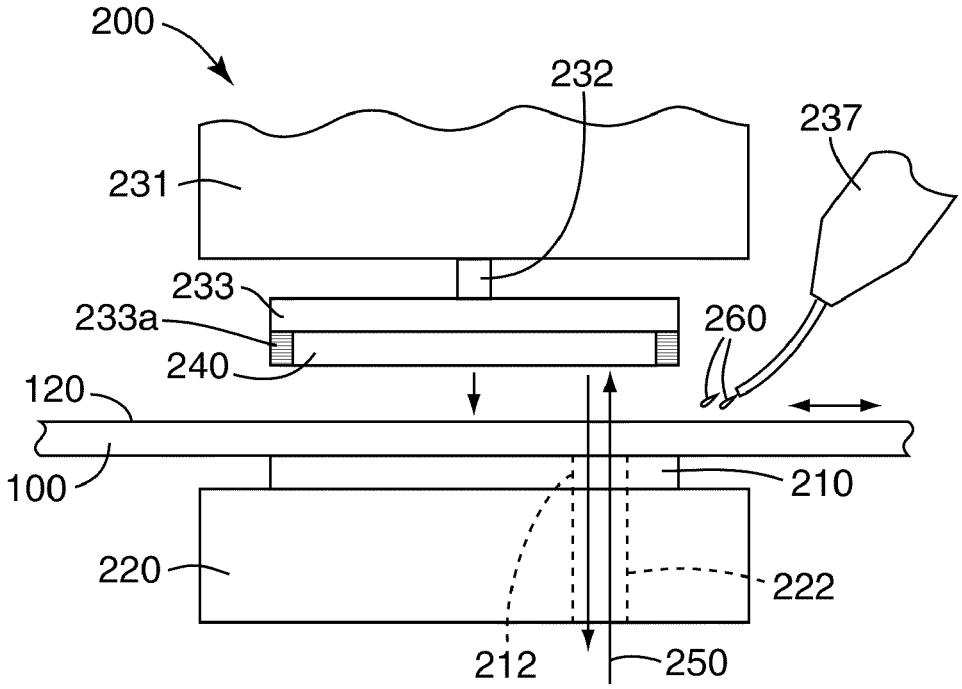
FIG. 2 is a schematic side view of an exemplary method of conditioning a surface of a wafer according to the present disclosure.

Referring now to FIG. 2, in an exemplary method of conditioning a surface of a wafer, structured abrasive article 100 contacts and is secured to subpad 210, which is in turn secured to platen 220. Subpad 210, which may comprise a foam (e.g., a polyurethane foam) or other compressible material, has first window 212 therein, and platen 220 has second window 222 therein. Wafer holder 233 is mounted to a head unit 231 that is connected to a motor (not shown). Gimbal chuck 232 extends from head unit 231 to wafer holder 233. Wafer holder 233 helps secure wafer 240 to head unit 231 and also prevent the semiconductor wafer from becoming dislodged during planarization. Wafer holder 233 extends alongside of wafer 240 at ring portion 233*a*. Ring portion 233*a* (which is optional) may be a separate piece or may be integral with wafer holder 233. Wafer 240 is brought into contact with the abrasive layer 120 of structured abrasive article 100, and the wafer 240 and abrasive layer 120 are moved relative to one another. The progress of polishing/abrading is monitored using laser beam 250 which passes through second window 222, first window 212, and structured abrasive article 100 and is reflected off oxide surface 242 wafer 240 and then retraces its path. Optional working fluid 260 may be used to facilitate the abrading process. Reservoir 237 holds optional working fluid 260 which is pumped through tubing 238 into the interface between semiconductor wafer and the abrasive layer. Useful working fluids include, for example, those listed in U.S. Pat. No. 5,958,794 (Bruxvoort et al.).

In general, wafer surface finishes that are substantially free of scratches and defects are desired. The surface finish of the wafer may be evaluated by known methods. One method is to measure the Rt value, which provides a measure of roughness, and may indicate scratches or other surface defects. The wafer surface is typically modified to yield an Rt value of no greater than about 0.4 nanometers, more typically no greater than about 0.2 nanometers, and even more typically no greater than about 0.05 nanometers. Rt is typically measured using a laser interferometer such as a Wyko RST PLUS interferometer (Wyko Corp., Tucson, Ariz.), or a Tencor profilometer (KLA-Tencor Corp., San Jose, Calif.). Scratch detection may also be measured by dark field microscopy. Scratch depths may be measured by atomic force microscopy.

Wafer surface processing may be conducted in the presence of a working fluid, which may be selected based upon the composition of the wafer surface. In some applications, the working fluid typically comprises water. The working fluid may aid processing in combination with the abrasive article through a chemical mechanical polishing process. During the chemical portion of polishing, the working fluid may react with the outer or exposed wafer surface. Then during the mechanical portion of processing, the abrasive article may remove this reaction product.

Objects and advantages of this disclosure are further illustrated by the following non-limiting examples, but the particular materials and amounts thereof recited in these examples, as well as other conditions and, details, should not be construed to unduly limit this disclosure.

EXAMPLES

Unless otherwise noted, all parts, percentages, ratios, etc. in the Examples and the rest of the specification are by weight.

Preparation of Ceria Dispersion 1

A ceria dispersion (10000 grams, 30.1 percent solids in water, 45 nanometer (nm) average primary particle size, available from Rhodia, Inc. of Cranberry, N.J.) was poured into a mixing vessel and then 72.41 grams of 2-(2-methoxyethoxy)ethoxyacetic acid, 58.57 grams of beta-carboxyethyl acrylate, and 5625 grams of 1-methoxy-2-propanol were slowly added while mixing using a polytetrafluoroethylene-coated blade. The mixture was heated to 50° C. and was mixed overnight. The mixture was then transferred into a rotary evaporator and excess water was removed under reduced pressure. The resultant dispersion had a solids content of 41.79 percent by weight.

Preparation of Ceria Dispersion 2

A ceria dispersion (10000 grams, 30.8 percent solids in water, 40 nm average primary particle size, available from Rhodia, Inc.) was poured into a mixing vessel and then 81.77 grams of 2-(2-methoxyethoxy)ethoxyacetic acid, 66.14 grams of beta-carboxyethyl, and 5625 grams of 1-methoxy-2-propanol were slowly added while mixing using a polytetrafluoroethylene-coated blade. The mixture was heated to 50° C. and was mixed overnight. The mixture was then transferred into a rotary evaporator and excess water was removed under reduced pressure. The resultant dispersion had a solids content of 43.21 percent by weight.

Preparation of Abrasive Slurry 1

Into a mixing vessel were mixed 2034 grams Ceria Dispersion 1, 12.8 grams of Disperbyk-111 wetting and dispersing additive (available from BYK-Chemie USA, Inc. of Wallingford, Conn.). To this mixture was added 6.24 grams of 2-hydroxyethyl methacrylate (available from Rohm and Haas Co. of Philadelphia, Pa.), 88.97 grams of 2-phenoxyethyl acrylate (available as SR 339, from Sartomer Co. of Exton, Pa.), 48.00 grams of trimethylolpropane triacrylate (available as SR 351 from Sartomer Co.), 6.806 grams of beta-carboxyethyl acrylate (available from Bimax Inc. of Cockeysville, Md.), and 0.75 gram of phenothiazine dissolved in 50 grams of 1-methoxy-2-propanol. The mixture was mixed using a polytetrafluoroethylene-coated blade for 30 minutes, then transferred to a rotary evaporator to remove the 1-methoxy-2-propanol. The slurry was cooled to room temperature, and then 0.91 gram of free-radical photoinitiator (phenyl bis(2,4,6-trimethylbenzoyl)phosphine oxide, available as IRGACURE 819 from Ciba Specialty Chemicals of Tarrytown, N.Y.), 0.29 gram of thermal free-radical initiator (2,2'-azobis(2,4-dimethylvaleronitrile, available as VAZO 52 from E. I. du Pont de Nemours and Co. of Wilmington, Del.) and 0.29 gram of hydroquinone monomethyl ether were added, followed by mixing for two hours.

Preparation of Abrasive Slurry 2

Into a mixing vessel were mixed 676 grams Ceria Dispersion 1, 3.2 grams of Disperbyk-111 wetting and dispersing additive (available from BYK-Chemie USA, Inc. of Wallingford, Conn.). To this mixture was added 3.33 grams of 2-hydroxyethyl methacrylate (available from Rohm and Haas Co. of Philadelphia, Pa.), 8.42 grams of 2-phenoxyethyl acrylate (available as SR 339 from Sartomer Co.), 64.62 grams of trimethylolpropane triacrylate (available as SR 351 from Sartomer Co.), 3.62 grams of beta-carboxyethyl acrylate (available from Bimax Inc.), and 0.4 gram of phenothiazine dissolved in 20 grams of 1-methoxy-2-propanol. The mixture was mixed using a polytetrafluoroethylene-coated blade for 30 minutes, then transferred to a rotary evaporator to remove the 1-methoxy-2-propanol. The slurry was cooled to room temperature, and then 0.46 gram of free-radical photoinitiator (phenyl bis(2,4,6-trimethylbenzoyl)phosphine oxide, available as IRGACURE 819 from Ciba Specialty Chemicals of Tarrytown, N.Y.), 0.15 gram of thermal free-radical initiator (2,2'-azobis(2,4-dimethylvaleronitrile, available as VAZO 52 from E. I. du Pont de Nemours and Co. of Wilmington, Del.) and 0.15 gram of hydroquinone monomethyl ether were added, followed by mixing for two hours.

Preparation of Abrasive Slurry 3

Into a mixing vessel were mixed 6737.3 grams Ceria Dispersion 2, 87.3 grams of DISPERBYK-111 wetting and dispersing additive (available from BYK-Chemie USA, Inc.). To this mixture was added 30.28 grams of 2-hydroxyethyl methacrylate (available from Rohm and Haas Co. of Philadelphia, Pa.), 183.53 grams of 2-phenoxyethyl acrylate (available as SR 339, from Sartomer Co. or Exton, Pa.)), 481.21 grams of trimethylolpropane triacrylate (available as SR 351 from Sartomer Co.), 32.98 grams of beta-carboxyethyl acrylate (available from Bimax Inc.), and 3.64 gram of phenothiazine dissolved in 500 grams of 1-methoxy-2-propanol. The mixture was mixed using a polytetrafluoroethylene-coated blade for 30 minutes, then transferred to a rotary evaporator to remove the 1-methoxy-2-propanol. The slurry was cooled to room temperature, and then 5.82 grams of free-radical photoinitiator (phenyl bis(2,4,6-trimethylbenzoyl)phosphine oxide, available as IRGACURE 819 from Ciba Specialty Chemicals of Tarrytown, N.Y.), 1.82 grams of thermal free-radical initiator (2,2'-azobis(2,4-dimethylvaleronitrile, available as VAZO 52 from E. I. du Pont de Nemours and Co. of Wilmington, Del.) and 1.82 grams of hydroquinone monomethyl ether were added, followed by mixing for two hours.

Comparative Example A

Ceria containing fixed abrasive web (CSA) available as SWR550-125/10 FIXED ABRASIVE from 3M Company of Saint Paul, Minn., which had the same pattern of structured composites and backing as SA1 (see below in Example 1), but contained cerium oxide having an average primary particle size of 135 nm.

Example 1

A roll of polypropylene production tool, 36 inches (91 cm) in width, was provided. The polypropylene production tool was polypropylene film that had a hexagonal array (350 micrometers on center) of hexagonal columnar cavities (125 micrometers wide and 30 micrometers deep), corresponding to a 10 percent cavitation area. The production tool was essentially the inverse of the desired shape, dimensions, and arrangement for the abrasive composites in the ultimate structured abrasive article. SLURRY 1 was coated between the cavities of production tool and roll of translucent polycarbonate/PBT based film backing material (7 mils (0.18 mm) thickness available as BAYFOL CR6-2 from Bayer Corp., Pittsburgh, Pa.) using a casting roll and a nip roll (nip force of 600 pounds (136 kg) 16.7 pounds per lineal inch (2.99 kg per lineal cm)) and then passed through an ultraviolet light (UV) source (V Bulb, Model EPIQ available from Fusion Systems), at a line speed of 10 feet/inch (3.0 m) and a total exposure of 6000 watts/inch (2.36 kJ/hr-cm). The resultant structured abrasive article (SA1) was removed from the production tool after being UV cured.

SA1 was used to polish thermal oxide blanket wafers (200 mm diameter silicon wafers with a 1 micrometer film thickness of silicon oxide on its surface) using a CMP polisher available under the trade designation REFLEXION polisher from Applied Materials, Inc. of Santa Clara, Calif. equipped with a subpad (60/90 SMOOTH SUBPAD available from 3M Company) using a wafer pressure of 1.5 pounds per square inch (1.5 kPa), a platen speed of 30 revolutions per minute, and a web index speed of 5 millimeters for 1 minute. A working fluid (deionized water containing 2.5 weight percent L-proline adjusted to a pH of 10.5 with potassium hydroxide, flow rate of 100 milliliters per minute) was used during the polishing process. SA1 was mounted.

Figure 3:
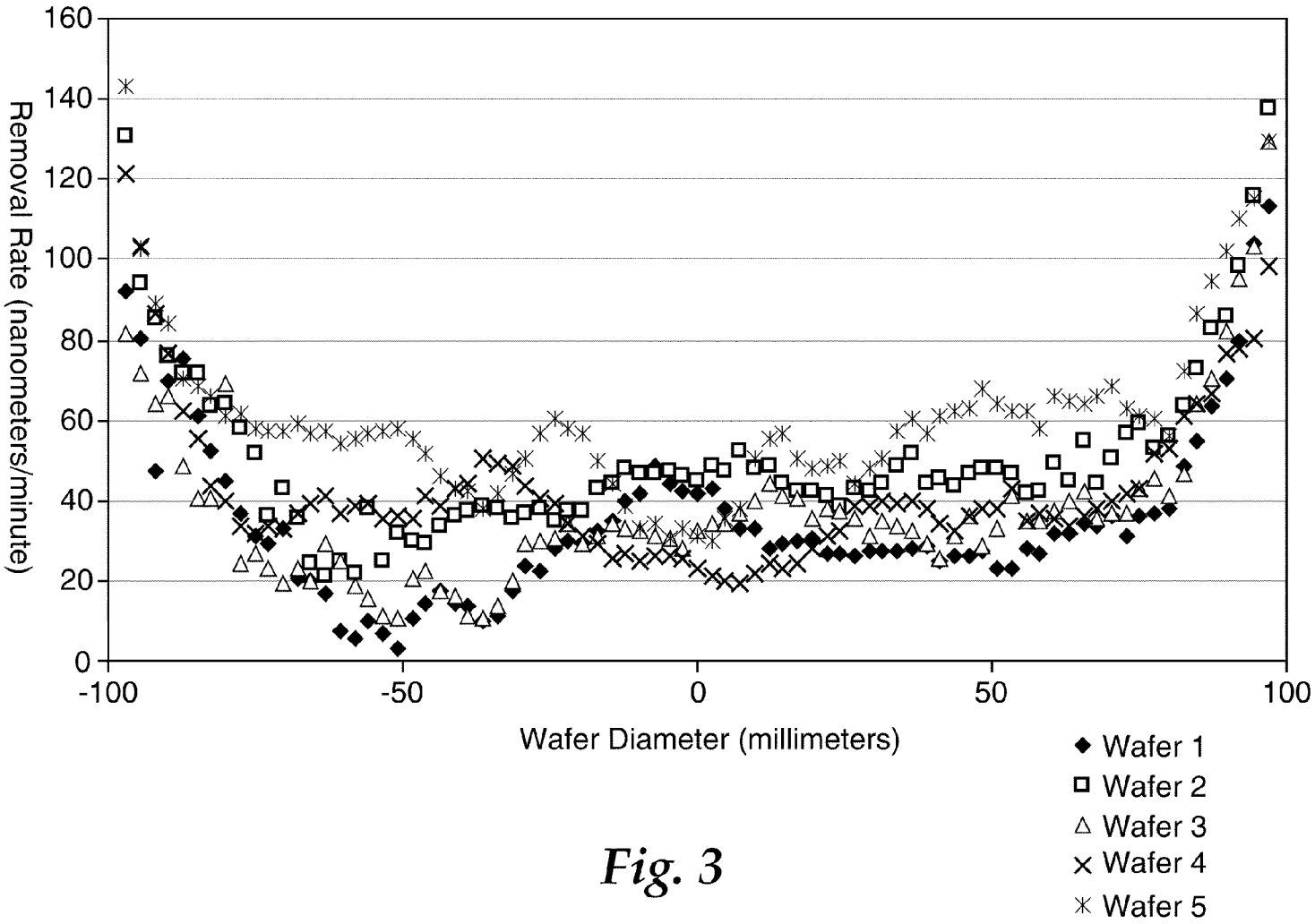
FIGS. 3-5 show silicon wafer polishing performance of exemplary structured abrasives according to the present disclosure.

SA1 was not conditioned prior to use. The polishing performance of SA1 tested on five thermal oxide blanket wafers is reported in FIG. 3.

Figure 6:
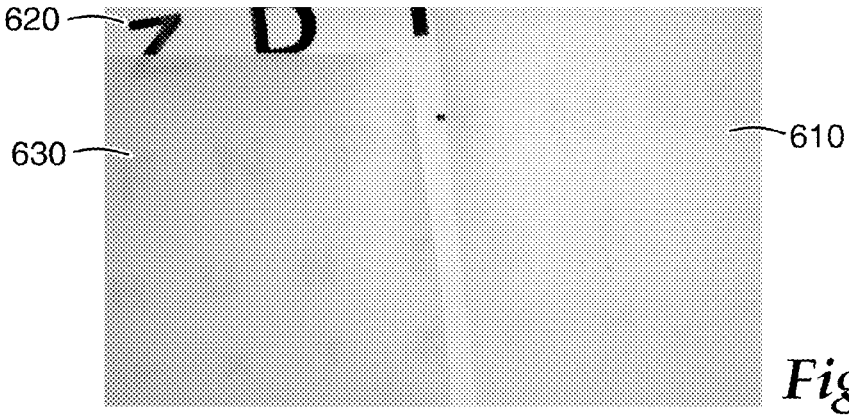
FIGS. 6-8 are photographs showing various structured abrasive articles in contact with a piece of paper having lettering thereon.

FIG. 6 shows specimens of SA1 (630) and CSA (610) in contact with a piece of printed paper (620), wherein each of SA1 and CSA were oriented with the abrasive layer contacting the printed paper.

Example 2

Example 1 was repeated, except that Abrasive Slurry 1 was replaced by Abrasive Slurry 2, resulting in structured abrasive article SA2.

Figure 4:
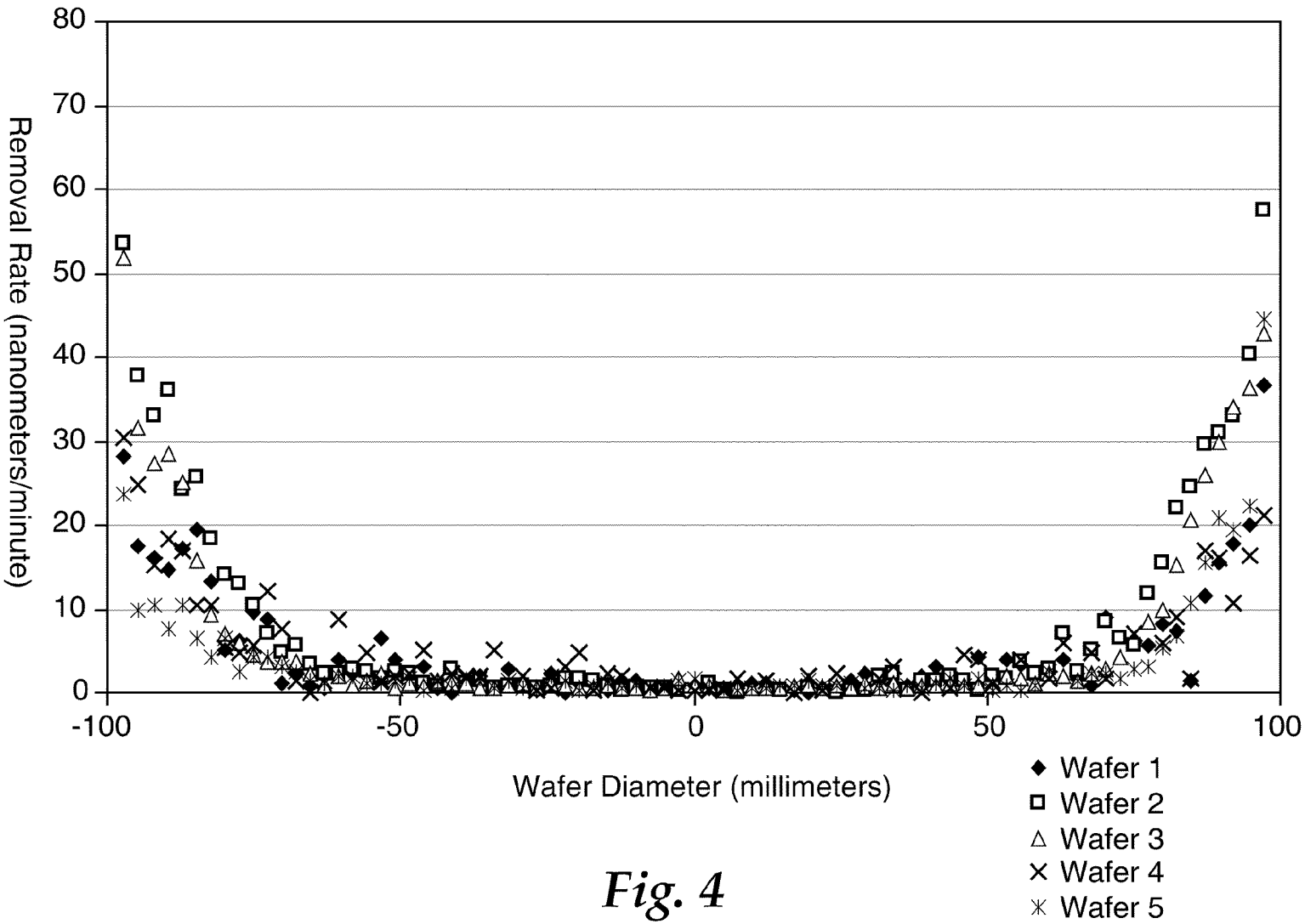

SA2 was not conditioned prior to use. The polishing performance of SA2 tested on thermal oxide blanket wafers is reported in FIG. 4.

Figure 7:
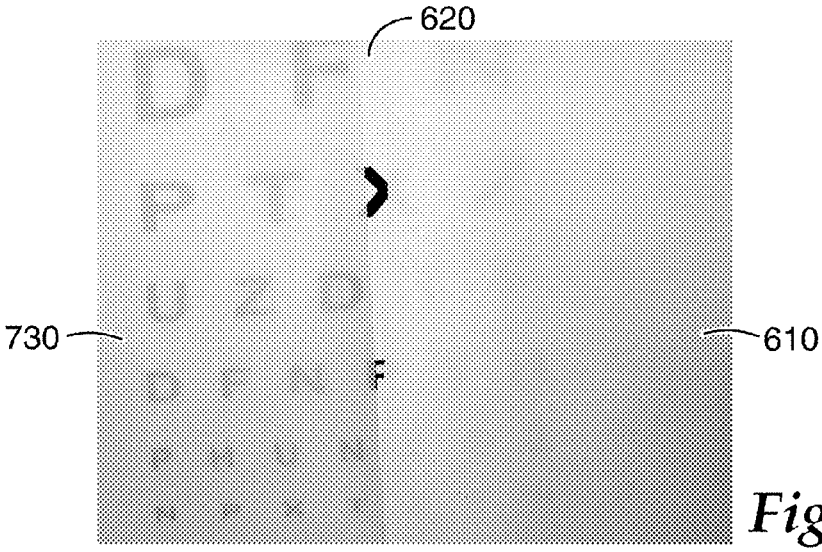

FIG. 7 shows specimens of SA2 (730) and CSA (610) in contact with printed paper 620, wherein each of SA2 and CSA were oriented with the abrasive layer contacting the printed paper.

Example 3

Example 2 was repeated, except that before polishing the thermal oxide blanket wafers SA2 was first conditioned in situ using a pad conditioner (available as CMP-20000TS from Morgan Advanced Ceramics of Allentown, Pa.) for 60 seconds, at a platen speed of 30 rpm, 5 sweep/min, from 2.75 to 12.50 inch across the web, and a working fluid (deionized water containing 2.5 weight percent L-proline adjusted to a pH of 10.5 with potassium hydroxide) flow rate of 100 milliliters per minute.

Figure 5:
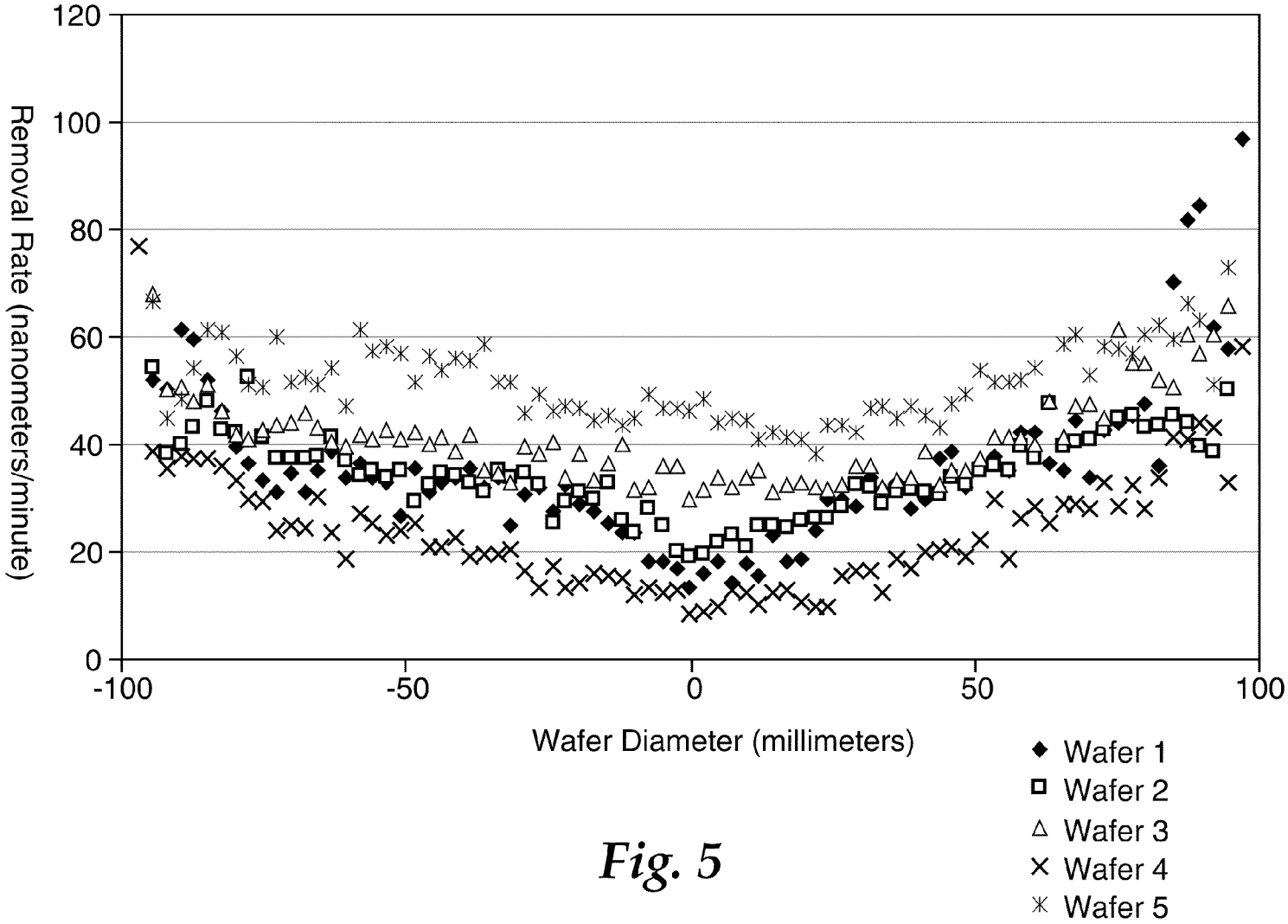

The polishing performance of SA2 tested on thermal oxide blanket wafers, after conditioning (as above) is reported in FIG. 5.

Example 4

Figure 8:
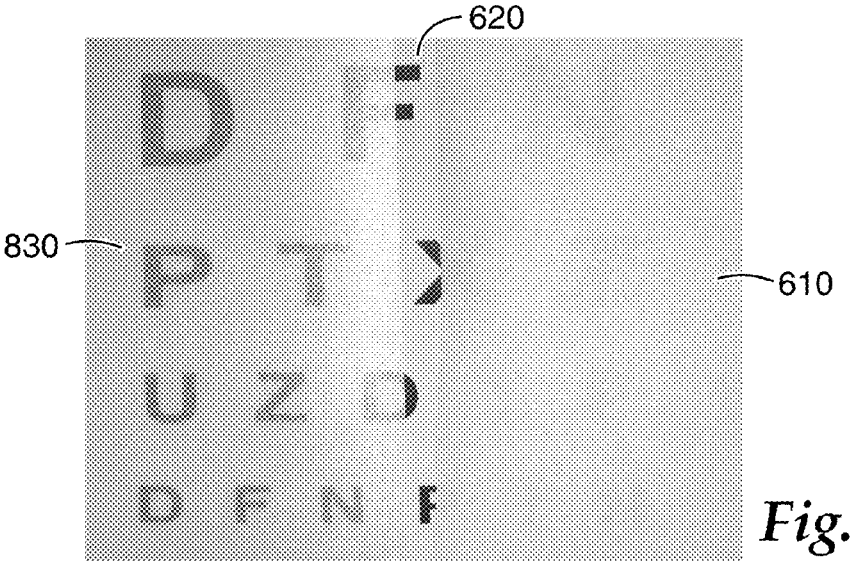

Example 1 was repeated, except that Abrasive Slurry 1 was replaced by Abrasive Slurry 3, resulting in structured abrasive article SA3. FIG. 8 shows specimens of SA3 (830) and CSA (630) in contact with printed paper 620, wherein each of SA3 and CSA were oriented with the abrasive layer contacting the printed paper.

Transmissivity Measurement

Samples of structured abrasive films were placed in a Perkin-Elmer Lambda 35 1.27 UV/Vis spectrometer such that the light beam was oriented perpendicular to the backing. Optical transmission (as a percentage) over the range 660 to 633 nanometers is reported in Table 1 (below).

TABLE 1

| WAVELENGTH, | PERCENT OPTICAL TRANSMISSION | | | |
|---|---|---|---|---|
| nanometers | CSA | SA1 | SA2 | SA3 |
| 660 | 0.211 | 4.306 | 5.454 | 6.323 |
| 659 | 0.208 | 4.286 | 5.433 | 6.310 |
| 658 | 0.206 | 4.264 | 5.410 | 6.301 |
| 657 | 0.204 | 4.242 | 5.384 | 6.290 |
| 656 | 0.207 | 4.222 | 5.362 | 6.280 |
| 655 | 0.206 | 4.207 | 5.351 | 6.275 |
| 654 | 0.201 | 4.191 | 5.328 | 6.270 |
| 653 | 0.200 | 4.166 | 5.304 | 6.257 |
| 652 | 0.197 | 4.143 | 5.283 | 6.247 |
| 651 | 0.195 | 4.121 | 5.259 | 6.239 |
| 650 | 0.194 | 4.096 | 5.235 | 6.225 |
| 649 | 0.190 | 4.077 | 5.213 | 6.212 |
| 648 | 0.190 | 4.056 | 5.191 | 6.202 |
| 647 | 0.188 | 4.038 | 5.169 | 6.196 |
| 646 | 0.187 | 4.019 | 5.146 | 6.186 |
| 645 | 0.186 | 3.996 | 5.126 | 6.176 |
| 644 | 0.184 | 3.971 | 5.104 | 6.168 |
| 643 | 0.180 | 3.951 | 5.080 | 6.159 |
| 642 | 0.177 | 3.933 | 5.060 | 6.150 |
| 641 | 0.175 | 3.911 | 5.036 | 6.141 |
| 640 | 0.174 | 3.891 | 5.015 | 6.133 |
| 639 | 0.176 | 3.867 | 4.993 | 6.124 |
| 638 | 0.174 | 3.847 | 4.972 | 6.110 |
| 637 | 0.170 | 3.830 | 4.952 | 6.104 |
| 636 | 0.169 | 3.809 | 4.931 | 6.094 |
| 635 | 0.167 | 3.786 | 4.906 | 6.081 |
| 634 | 0.165 | 3.765 | 4.879 | 6.067 |
| 633 | 0.165 | 3.742 | 4.852 | 6.059 |

All patents and publications referred to herein are hereby incorporated by reference in their entirety. Various modifications and alterations of this disclosure may be made by those skilled in the art without departing from the scope and spirit of this disclosure, and it should be understood that this disclosure is not to be unduly limited to the illustrative embodiments set forth herein.

What is claimed is:

1. A method of conditioning an oxide surface of a wafer, the method comprising:

providing a structured abrasive article comprising:

an at least translucent film backing; and an abrasive layer disposed on the at least translucent film backing and comprising a plurality of shaped abrasive composites, wherein the shaped abrasive composites comprise abrasive particles dispersed in a binder, wherein the abrasive particles consist essentially of ceria particles having an average primary particle size of less than 100 nanometers, wherein the binder comprises a polyether acid and a reaction product of components comprising a carboxylic(meth)acrylate and a poly(meth)acrylate, and wherein based on a total weight of the abrasive layer, the abrasive particles are present in an amount of at least 70 percent by weight;

conditioning the abrasive layer;

contacting the at least translucent film backing with a subpad, the subpad having a first window extending therethrough;

securing the subpad to a platen, the platen having a second window extending therethrough and contiguous with the first window;

frictionally contacting the abrasive layer with the oxide surface of the wafer; and moving at least one of the abrasive layer or the wafer to abrade the surface of the wafer while in contact with a working fluid; and monitoring a surface characteristic of the wafer using a visible light beam directed through the first window, the second window, and the structured abrasive article.

2. The method of claim 1, wherein if viewed perpendicular to the abrasive layer, the structured abrasive article has an optical transmission in a wavelength range of from 633 to 660 nanometers of at least 3.5 percent.

3. The method of claim 1, wherein the shaped abrasive composites consist essentially of posts lengthwise oriented perpendicular to the at least translucent film backing.

4. The method of claim 1, wherein the carboxylic(meth) acrylate comprises beta-carboxyethyl acrylate.

5. The method of claim 1, wherein the components further comprise a mono(meth)acrylate.

6. The method of claim 1, wherein the visible light beam comprises a laser beam.

7. A structured abrasive article comprising:

an at least translucent film backing; and an abrasive layer disposed on the at least translucent film backing and comprising a plurality of shaped abrasive composites, wherein the shaped abrasive composites comprise abrasive particles dispersed in a binder, wherein the abrasive particles consist essentially of ceria particles having an average primary particle size of less than 100 nanometers, wherein the binder comprises a polyether acid and a reaction product of components comprising a carboxylic(meth)acrylate and a poly (meth)acrylate, and wherein, based on a total weight of the abrasive layer, the abrasive particles are present in an amount of at least 70 percent by weight.

8. The structured abrasive article of claim 1, wherein if viewed perpendicular to the abrasive layer, the structured abrasive article has an optical transmission in a wavelength range of from 633 to 660 nanometers of at least 3.5 percent.

9. The structured abrasive article of claim 1, wherein if viewed perpendicular to the abrasive layer, the structured abrasive article has an optical transmission at a wavelength of 633 nanometers of at least 3.5 percent.

10. The structured abrasive article of claim 1, wherein the shaped abrasive composites consist essentially of posts lengthwise oriented perpendicular to the at least translucent film backing.

11. The structured abrasive article of claim 1, wherein the carboxylic(meth)acrylate comprises beta-carboxyethyl acrylate.

12. The structured abrasive article of claim 1, wherein the components further comprise a mono(meth)acrylate.

13. A method of making a structured abrasive article, the method comprising:

combining ceria particles, a polyether acid, a carboxylic (meth)acrylate, and solvent to form a dispersion, wherein the ceria particles have an average primary particle size of less than 100 nanometers;

combining the dispersion with components comprising a poly(meth)acrylate to form a binder precursor;

forming a layer of the binder precursor on an at least translucent film backing;

contacting the binder precursor with a production tool having a plurality of precisely-shaped cavities;

curing the binder precursor to form an abrasive layer disposed on the at least translucent film backing;

separating the abrasive layer from the production tool to provide the structured abrasive article, wherein based on a total weight of the abrasive layer, the ceria particles are present in an amount of at least 70 percent by weight.

14. The method of claim 13, wherein if viewed perpendicular to the abrasive layer, the structured abrasive article has an optical transmission in a wavelength range of from 633 to 660 nanometers of at least 3.5 percent.

15. The method of claim 13, wherein the shaped abrasive composites consist essentially of posts lengthwise oriented perpendicular to the at least translucent film backing.

16. The method of claim 13, wherein the components further comprise a free-radical photoinitiator, and wherein said curing the binder precursor is achieved by radiation curing.

17. The method of claim 13, wherein the components further comprise a free-radical thermal initiator.

18. The method of claim 17, further comprising thermally post-curing the abrasive layer.

19. The method of claim 13, wherein the carboxylic(meth) acrylate comprises beta-carboxyethyl acrylate.

20. The method of claim 13, wherein the components further comprise a mono(meth)acrylate.

* * * * *

UNITED STATES PATENT AND TRADEMARK OFFICE

CERTIFICATE OF CORRECTION

PATENT NO. : 8,251,774 B2
APPLICATION NO. : 12/539798
DATED : August 28, 2012
INVENTOR(S) : William D Joseph It is certified that error appears in the above-identified patent and that said Letters Patent is hereby corrected as shown below:

Column 16
Line 43, In Claim 8, delete "claim 1," and insert -- claim 7, --, therefor.

Column 16
Line 47, In Claim 9, delete "claim 1," and insert -- claim 7, --, therefor.

Column 16
Line 51, In Claim 10, delete "claim 1," and insert -- claim 7, --, therefor.

Column 16
Line 55, In Claim 11, delete "claim 1," and insert -- claim 7, --, therefor.

Column 16
Line 58, In Claim 12, delete "claim 1," and insert -- claim 7, --, therefor.

Signed and Sealed this
Fourth Day of December, 2012

David J. Kappos

David J. Kappos
*Director of the United States Patent and Trademark Office*